US010519734B2

(12) United States Patent
Messa et al.

(10) Patent No.: US 10,519,734 B2
(45) **Date of Patent: *Dec. 31, 2019**

(54) DOWNHOLE MILLING TOOL APPARATUS

(71) Applicant: EXTREME ENERGY SERVICES, L.L.C., Broussard, LA (US)

(72) Inventors: Richard Messa, Broussard, LA (US); Christopher Gasser, Houston, TX (US); Brady Guilbeaux, Maurice, LA (US); Ashley Rochon, New Iberia, LA (US); Duane Dunnahoe, Broussard, LA (US)

(73) Assignee: EXTREME ENERGY SERVICES, L.L.C., Broussard, LA (US)

( * ) Notice: Subject to any disclaimer, the term of this patent is extended or adjusted under 35 U.S.C. 154(b) by 109 days.

This patent is subject to a terminal disclaimer.

(21) Appl. No.: 15/428,927

(22) Filed: Feb. 9, 2017

(65) Prior Publication Data

US 2018/0223616 A1 Aug. 9, 2018

(51) Int. Cl.
*E21B 29/00* (2006.01)
*E21B 10/567* (2006.01)

(52) U.S. Cl.
CPC ..... *E21B 29/002* (2013.01); *E21B 10/567* (2013.01)

(58) Field of Classification Search
CPC ..... E21B 29/002; E21B 10/26; E21B 10/567; E21B 10/60
See application file for complete search history.

(56) References Cited

U.S. PATENT DOCUMENTS 2,022,735 A * 12/1935 Pearce ..... E21B 10/26 175/391
3,114,416 A * 12/1963 Kammerer ..... E21B 29/002 166/55.7
5,641,027 A * 6/1997 Foster ..... E21B 4/02 175/107
2011/0240367 A1* 10/2011 Guidry ..... E21B 29/002 175/57
2018/0223617 A1* 8/2018 Messa ..... E21B 10/567

* cited by examiner

*Primary Examiner* — D. Andrews
(74) *Attorney, Agent, or Firm* — Keaty Law Firm LLC

(57) ABSTRACT

A downhole milling tool apparatus for use in milling through hard substances, such as barite, found in underground wells, providing a stepped increase of diameters and positioning of carbide cutters and appropriate positioning of fluid ports and channels, to provide removal of cuttings and cooling and lubricating of the cutting head, in turn providing more efficiency and a better rate of penetration (ROP).

8 Claims, 5 Drawing Sheets

DOWNHOLE MILLING TOOL APPARATUS

BACKGROUND OF THE INVENTION

This invention provides a downhole milling tool apparatus for use in milling through hard substances found in underground wells, including but not limited to barite (barium sulfate) deposits.

When drilling or working on an oil and gas well, an effective way to work safely is to "kill" the well. In essence, this means having a column of drilling mud on top of the pressurized wellbore fluids to prevent them from escaping the well at the surface. Depending on the pressure the well is producing, a different density of fluid or "mud weight" is used, with a higher mud weight to negate the effects of a higher pressure well. Barite (also known as barium sulfate, $BaSO_4$) is used to increase the mud weight, or "weight up". However, in use, some of the barite settles out of the mud and leaves deposits on the casing. When production tubing is installed inside that casing everything is clean; over time, however, some of this barium sulfate leaches inside the production tubing through wellbore fluids. This is especially prevalent at the connections, and at high downhole temperatures it hardens to a scale buildup and is difficult to drill through.

The rate of penetration (ROP) decreases significantly when drilling barium sulfate. Current tools on the market to combat this issue are plagued with decreasing ROP's (rates of penetration) and premature wear. Oftentimes, crews need to trip out of the well in order to change worn bits/mills before going back into the well. This increases the time spent working on a well and therefore increases cost.

In coiled-tubing drilling and workover operations, drilling fluid or drilling mud under pressure is used as the motive force for drilling or milling tools. In all drilling and workover operations, drilling fluid is used for cooling and for carrying away cuttings, in suspension, up the annulus toward the wellbore. It is characteristic of barite that grinding it past the flaky, large-particle state into a powdery, small-particle state causes the drilling-fluid-and-barite suspension to become more cement-like and less easily flowed up the annulus. Therefore, barite deposits need to be effectively chipped or flaked off without powdering. The initial contact of a given carbide bit with a barite deposit is not likely to cause powdering, but the subsequent action of following carbide bits in a rotating tool might cause such powdering.

Also, as stated above, drilling or milling through barite or substances of similar character are very tough on carbide bits, highlighting a need to chip or flake, but not powder, with as little wear to the carbide bits as possible. The present state of the art does not provide for these needs.

There is accordingly a need for a milling tool that can increase the ROP, but also be durable enough to go through barite without issue.

SUMMARY OF THE INVENTION

This invention provides a downhole milling tool for use in milling through hard substances found in underground wells, such as barite, providing a stepped increase of diameters and positioning of carbide cutters and appropriate positioning of fluid ports and channels, to provide removal of cuttings and cooling and lubricating of the cutting head. The method of conducting this milling operation further includes rotation of the torque developed by the mud motor, and a particular amount of fluid supplied to the mud motor and the milling tool through the particular ports, which results in removal of the cuttings. The downhole milling tool provides a clean and cool cutting surface, which equals more efficiency and therefore a better rate of penetration (ROP). The internal flow path or channel allows for better cutting-face cooling, as well as better flushing of debris.

BRIEF DESCRIPTION OF DRAWINGS

Reference will now be made to the drawings, wherein like parts are designated by like numerals, and wherein.

DETAILED DESCRIPTION OF THE DRAWINGS

Figure 1:
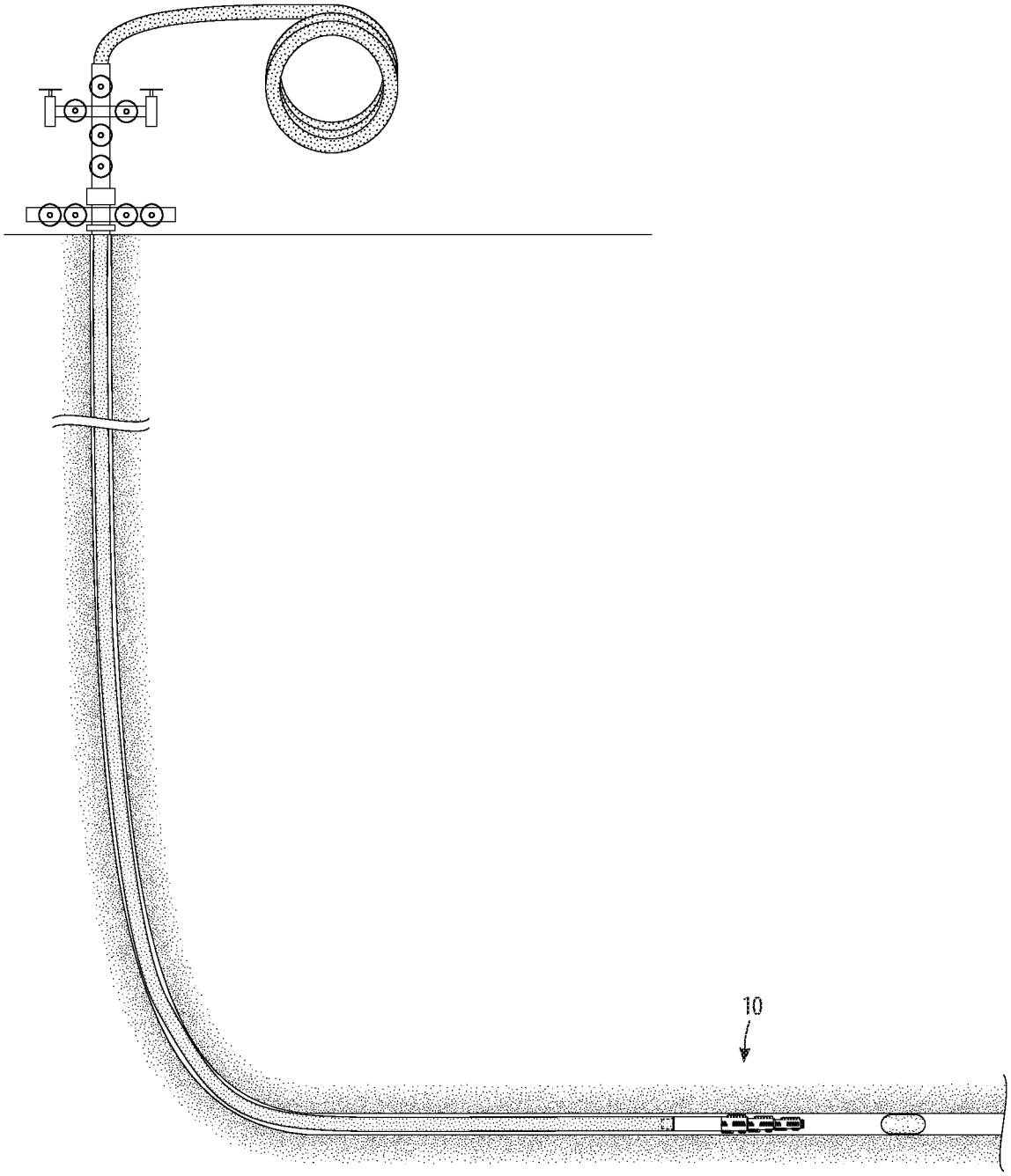
FIG. 1 is a schematic view illustrating the downhole milling tool of the invention in use.

Referring to FIG. 1, the downhole milling tool 10 of the invention is used in the bottom hole assembly (BHA) on a workstring in coiled-tubing drilling and workover operations. It is particularly effective in drilling through barite (barium sulfate, $BaSO_4$) that has either leached into the hole or has been placed deliberately in order to seal the hole. Typically, the bottom hole assembly is run on 1.25 in. coiled tubing inside 2.875 in. 8.7 lb./ft. production tubing.

Figure 2:
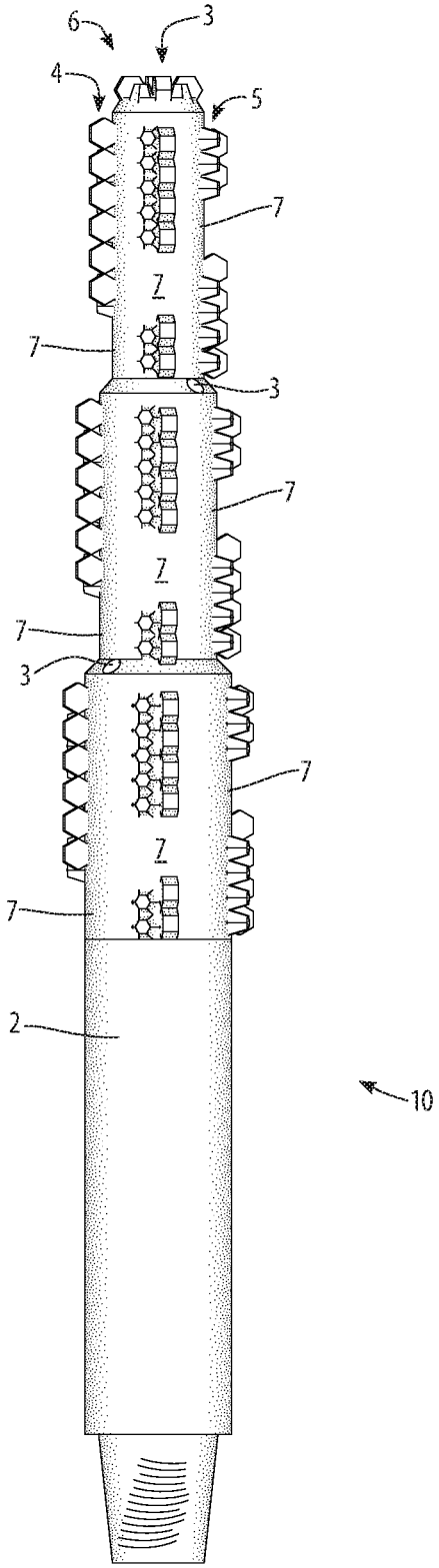
FIG. 2 is a nominal top view of the downhole milling tool of the invention.
Figure 3:
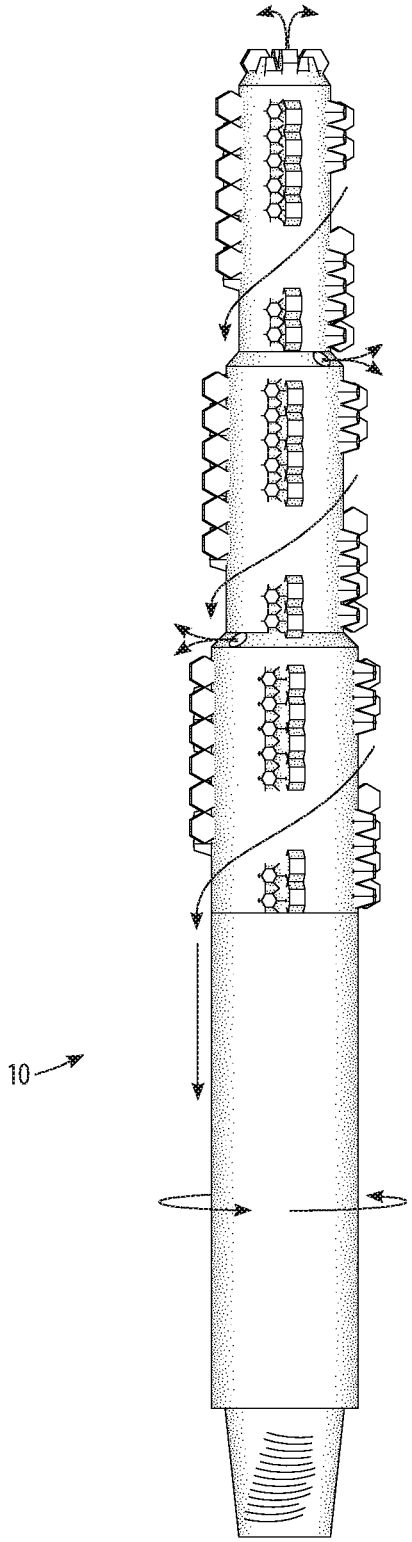
FIG. 3 is a nominal top view of the downhole milling tool of the invention schematically showing fluid flow in use.

Referring to FIG. 2 & FIG. 3, the downhole milling tool 10 provides a tool body 2 which mounts on a bottom hole assembly at an up-hole end. The tool body 2 is essentially tubular or cylindrical, with an axial channel for the flow of drilling fluid or mud under pressure. The tool body 2 also provides at least one step down of the diameter of the outer surface. A preferred embodiment has two steps down, with a largest diameter of the tool body between 2 and 2.5 inches, inclusive, stepping down twice in increments of one-half inch. Each step down creates a shoulder. The tool body 2 can be made of steel.

Fluid ports 3 are provided at each shoulder and at the downhole or leading end. Pressurized drilling fluid or mud from the axial channel of the tool body 2 is expelled through the fluid ports 3 to provide cooling and lubrication, and to flush cuttings or debris up the annulus.

Tungsten carbide inserts or bits are attached by welding directly to the tool body 2 in order to provide cutting faces. The bits are attached so that the farthest-out edge of a given bit is at one of two heights, a higher one and a lower one. This difference in heights can be achieved either by using two different sizes of bits, or by mounting the same bits in two different orientations. The bits are attached to the external surface of the tool body 2 in double rows 4, 5, and also as a forward-bits group 6 at the downhole end of the tool body 2. Each double row of bits is arranged as a leading-bits row 4 and a following-bits row 5, with the leading-bits row 4 containing higher-reaching bits, and the following-bits row 5 containing lower-reaching bits. The alignment of each row does not have to be as precise as illustrated, but can be somewhat varied. The double rows 4, 5 are distributed around the circumference of the tool body 2 in a balanced orientation, such as the 90 degrees for four double rows illustrated, or 120 degrees for three double rows. Between each double row 4, 5 and any adjacent double row a no-bit area 7 is left between the double rows, where no bits are attached. These no-bit areas 7 therefore form rows parallel to the double rows. These are axially oriented no-bit areas, which form channels for spoil-laden drilling fluid to travel upward. Additionally, each double row 4, 5 contains a gap along the rows where no bits are attached, forming additional no-bit areas 7. Each no-bit area gap is located between two axially oriented no-bit areas, and merges those no-bit areas, forming lateral channels. In a preferred embodiment, as illustrated, the gaps are located at different places along each double row so that a continuous helical channel is formed. Where the downhole milling tool 10 is spinning in the standard right-hand or clockwise direction, the helical channel is arranged to conduct spoil-laden drilling fluid up the hole.

Figure 4:
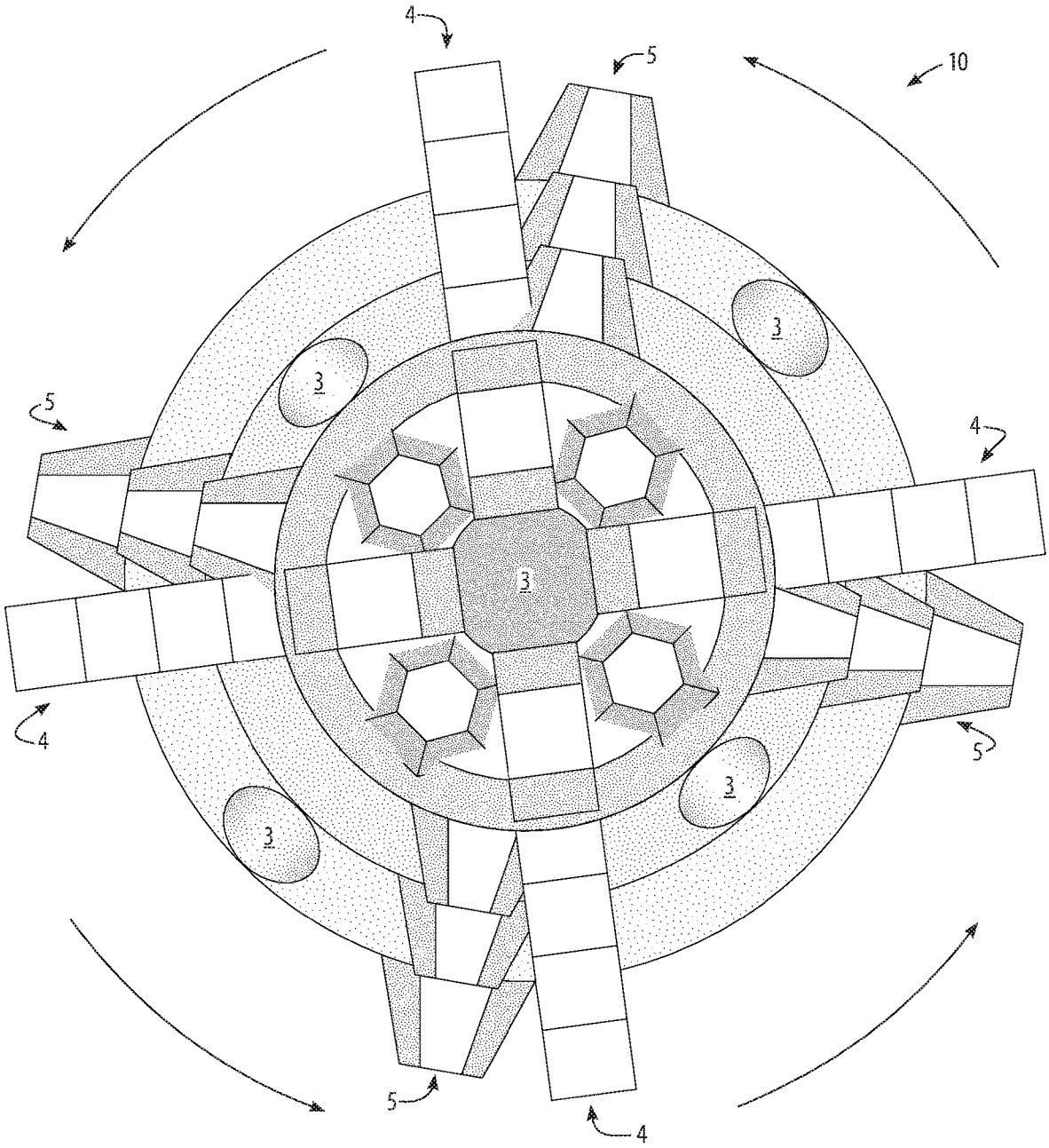
FIG. 4 is a nominal front view of the downhole milling tool of the invention.
Figure 5:
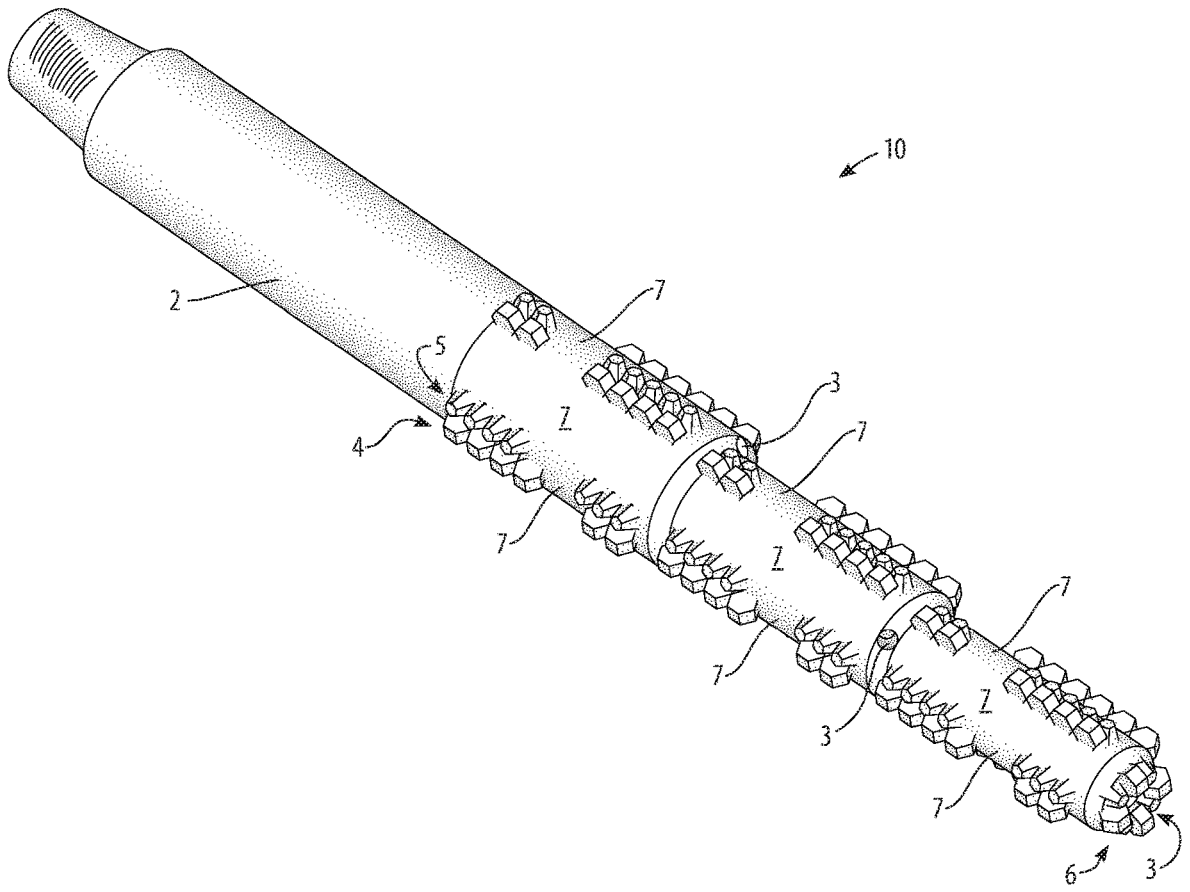
FIG. 5 is a perspective view of the downhole milling tool of the invention.
Figure 6:
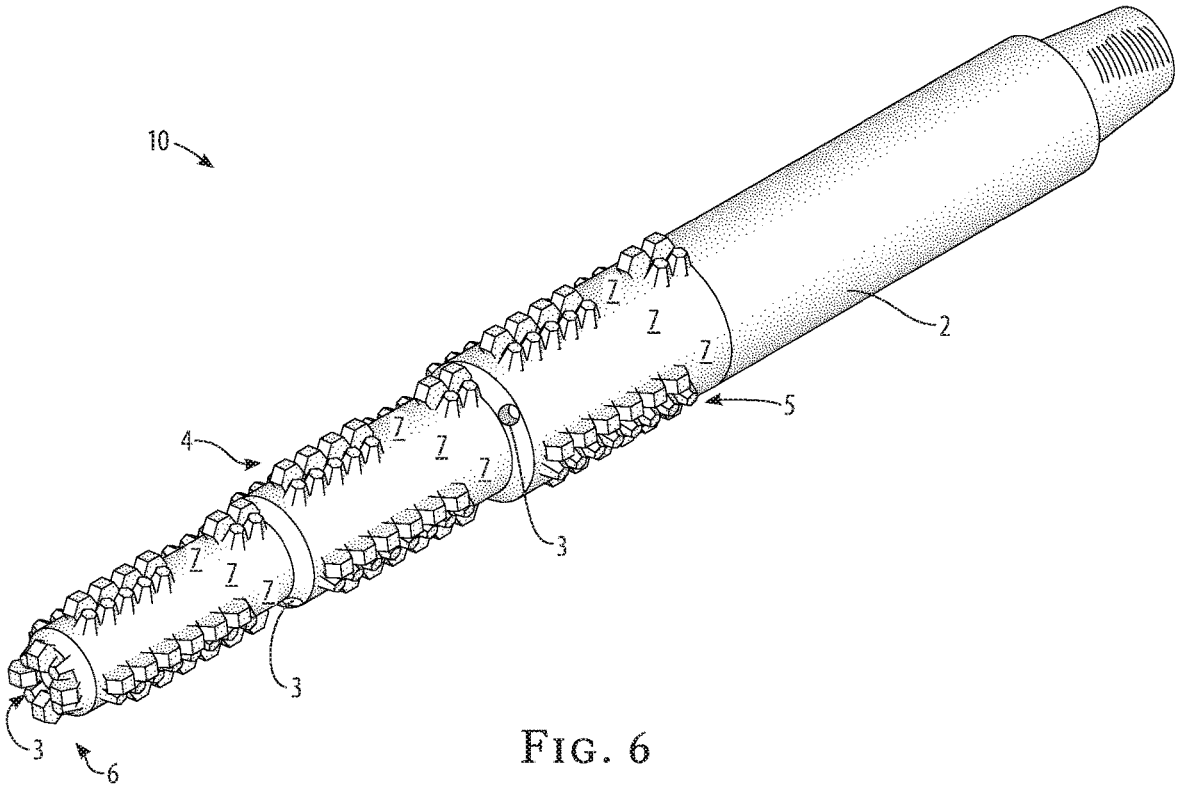
FIG. 6 is a perspective view of the downhole milling tool of the invention.
Figure 7:
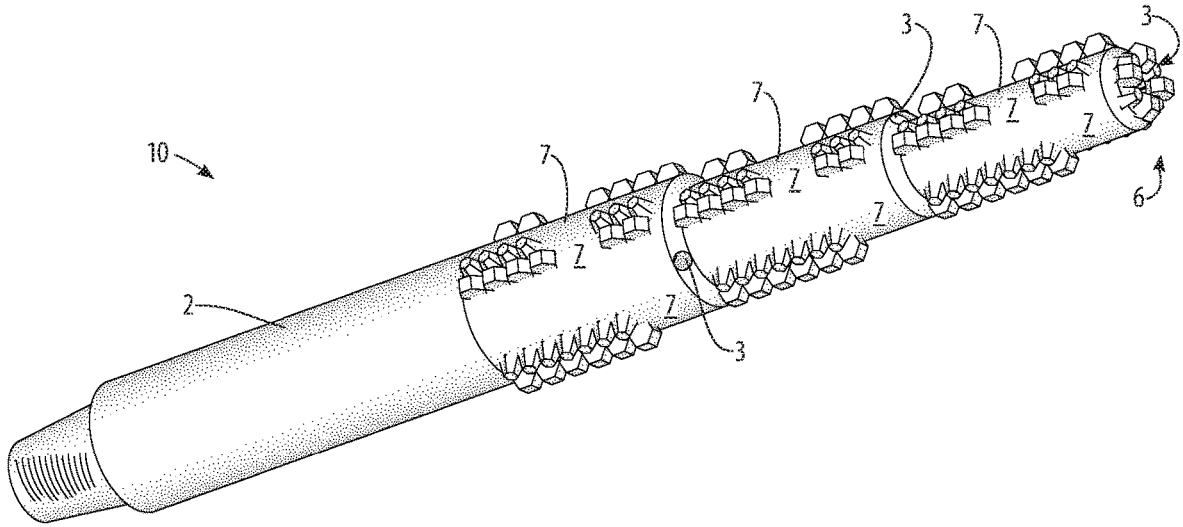
FIG. 7 is a perspective view of the downhole milling tool of the invention.

Referring additionally to FIG. 4, in a preferred embodiment, the fluid ports 3 on the shoulders of the tool body are placed in the axially oriented no-bit areas.

In use, spinning in a standard right-hand or clockwise direction, the forward-bits group 6 makes initial contact with a smaller central cross-sectional area of the hard material and begins breaking it up. The operation is cooled and lubricated, and the cuttings are being flushed away by, drilling fluid or mud expelled from the fluid port 3 at the downhole end. As the downhole milling tool 10 advances, a slightly-larger-circumference area of material is chipped away by the leading-bits rows 4. Each leading-bits row 4 is followed immediately by a following-bits row 5, which further chips or crushes the cuttings to an optimal size for being flushed away by the drilling fluid, but without reducing the cuttings to a powder, which would become cementitious and would resist flushing. Additional drilling fluid is expelled from fluid ports 3 at the shoulders. The arrangement of no-bit areas 7 forming a helical channel allows the flow of drilling fluid to flush away the cuttings or spoil upwards. As the downhole milling tool 10 advances further, a larger-circumference area of material is removed by the next-larger portion of the downhole milling tool 10. The process repeats for each step up in diameter.

In use, the downhole milling tool 10 provides a clean and cool cutting surface, which equals more efficiency and therefore a better rate of penetration (ROP). The internal flow path or channel allows for better cutting face cooling as well as better flushing of debris.

Many changes and modifications can be made in the present invention without departing from the spirit thereof. I therefore pray that my rights to the present invention be limited only by the scope of the appended claims.

We claim:

1. A downhole milling tool apparatus for mounting on a coiled-tubing work string having, in use, a downhole direction and a wellhead direction, and a direction of spin, the downhole milling tool comprising:

(i) a tool body adapted to being mounted on the downhole end of a coiled-tubing work string, said tool body having a cylindrical tubular form with a perimeter and an internal axial conduit for passage of drilling fluid, having a maximum external-surface diameter portion towards the wellhead end, and at least one stepped-down external-surface portion towards the downhole end, and having a shoulder at each step-change of external-surface diameter;

(ii) a plurality of fluid ports adapted to allow passage of drilling fluid from the internal axial conduit of said tool body out through the external surfaces of said tool body, at least one said fluid port being located on the downhole end of said tool body, and at least one said fluid port on each shoulder of said tool body;

(iii) a forward-bits group comprising carbide bits affixed to the downhole end of said tool body;

(iv) at least two leading-bits rows, each comprising carbide bits affixed to the external surface of said tool body, and having a first average profile radially perpendicular to said tool body, and being affixed in a rotationally balanced relationship with maximal spacing from each other around the perimeter; and (v) at least two following-bits rows, each comprising carbide bits affixed to the external surface of said tool body, and having a second average profile, lower than the first, radially perpendicular to said tool body, being affixed in a rotationally balanced relationship with maximal spacing from each other around the perimeter;

where each said following-bits row is further affixed to said tool body adjacent to a corresponding said leading-bits row, such that, in use, each said leading-bits row precedes the corresponding said following-bits row along the direction of spin;

where each adjacent pair of a said leading-bits row and said following-bits row are affixed in a rotationally balanced relationship with maximal spacing from each other around the perimeter, and defining an axially oriented continuous no-bit area on the external surface of the tool body between each said adjacent pair; and where each adjacent pair of a said leading-bits row and a said following-bits row provides a gap defining a no-bit area on the external surface of said tool body along each said adjacent pair, and each said no-bit area gap provides communication across said adjacent pair between said axially oriented no-bit areas; and where, in use, drilling fluid exits each said fluid port and suspends spoil, and subsequently moves with the suspended spoil towards the wellhead along channels defined by said no-bit areas.

2. The downhole milling tool of claim 1, where said tool body is made of steel.

3. The downhole milling tool of claim 1, where said tool body has a largest external-surface diameter of between 2 and 2.5 inches, inclusive.

4. The downhole milling tool of claim 1, where said stepped-down external-surface portion has a diameter of between 1.5 and 2 inches, inclusive.

5. The downhole milling tool of claim 1, where said stepped-down external-surface portion has a diameter of between 1 and 1.5 inches, inclusive.

6. The downhole milling tool of claim 1, where said at least one stepped-down external-surface portion further comprises at least two stepped-down external-surface portions.

7. The downhole milling tool of claim 1, where said no-bit area gaps are further arranged to provide a helical path of gaps.

8. The downhole milling tool of claim 1, where said fluid ports further comprise two said fluid ports at each shoulder, arranged in a 180-degree relationship each to the other.

* * * * *